United States Patent [19]

Nichols

[11] Patent Number: 4,629,192

[45] Date of Patent: Dec. 16, 1986

[54] INTERLOCKING PUZZLE BLOCKS

[76] Inventor: Franklin Nichols, 2510 S. Norfolk, Tulsa, Okla. 74114

[21] Appl. No.: 735,614

[22] Filed: May 20, 1985

[51] Int. Cl.[4] ..... A63F 9/04; A63F 9/12; A63H 33/08

[52] U.S. Cl. ..... 273/156; 273/146; 273/241; 273/271; 446/118; 446/125

[58] Field of Search ..... 273/146, 156, 157 R; 434/277, 278, 279; 446/118, 122, 123, 124, 125, 128, 85

[56] References Cited

U.S. PATENT DOCUMENTS

| | | | |
|---|---|---|---|
| 580,542 | 4/1897 | Battey . | |
| 1,030,554 | 6/1912 | Wharton | 273/146 UX |
| 1,472,536 | 10/1923 | Thomson | 434/278 X |
| 1,725,911 | 8/1929 | Graham | 446/118 |
| 2,262,199 | 11/1941 | Paulson . | |
| 3,405,479 | 10/1968 | Paulson . | |
| 3,420,527 | 1/1969 | Morin . | |
| 3,481,068 | 12/1969 | Paulson . | |
| 3,481,603 | 12/1969 | Sugden . | |
| 3,570,170 | 3/1971 | Kishi . | |
| 3,605,322 | 9/1971 | Matsubayashi et al. . | |
| 3,611,620 | 6/1972 | Wolf . | |
| 3,716,939 | 2/1973 | Pibet . | |
| 3,717,948 | 2/1973 | Schnabel . | |
| 3,822,499 | 7/1974 | De Vos | 446/121 |
| 3,862,512 | 1/1975 | Vogel . | |
| 3,945,645 | 3/1976 | Roberts | 273/157 R |
| 4,060,952 | 12/1977 | Hernandez . | |
| 4,129,960 | 12/1978 | Gale . | |
| 4,239,231 | 12/1980 | Henderson . | |
| 4,306,373 | 12/1981 | Chatani . | |
| 4,397,466 | 8/1983 | Nichols . | |

FOREIGN PATENT DOCUMENTS

| | | | |
|---|---|---|---|
| 1959249 | 6/1971 | Fed. Rep. of Germany | 446/124 |
| 1089076 | 9/1954 | France | 446/122 |
| 1315949 | 12/1962 | France | 446/128 |

*Primary Examiner*—Anton O. Oechsle

*Attorney, Agent, or Firm*—Richards, Harris, Medlock & Andrews

[57] ABSTRACT

A building puzzle block includes an elongated body portion in the form of a rectangular parallelepipedon. Spheres are attached to the body portion along edges thereof and at spaced distances. An equal number of receiving sockets are formed at spaced distances. An equal number of receiving sockets are formed at spaced distances on the edges of the body portion for interconnecting the blocks with other similar blocks.

17 Claims, 14 Drawing Figures

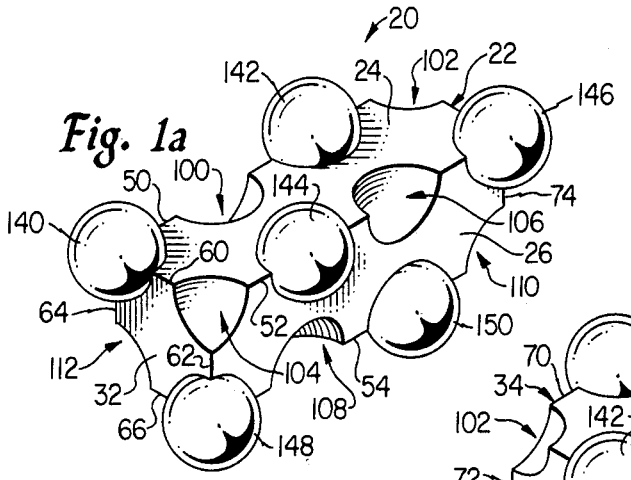
Fig. 1a
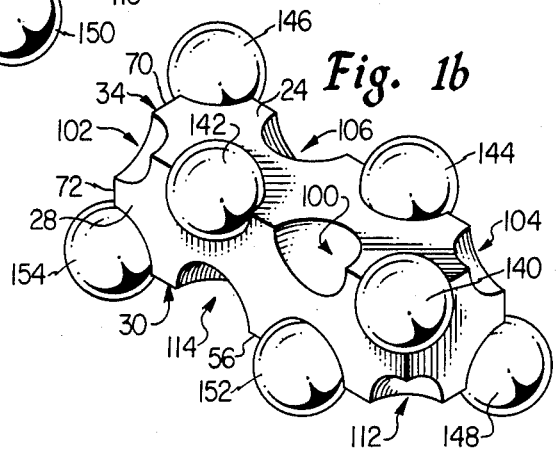
Fig. 1b
Fig. 2
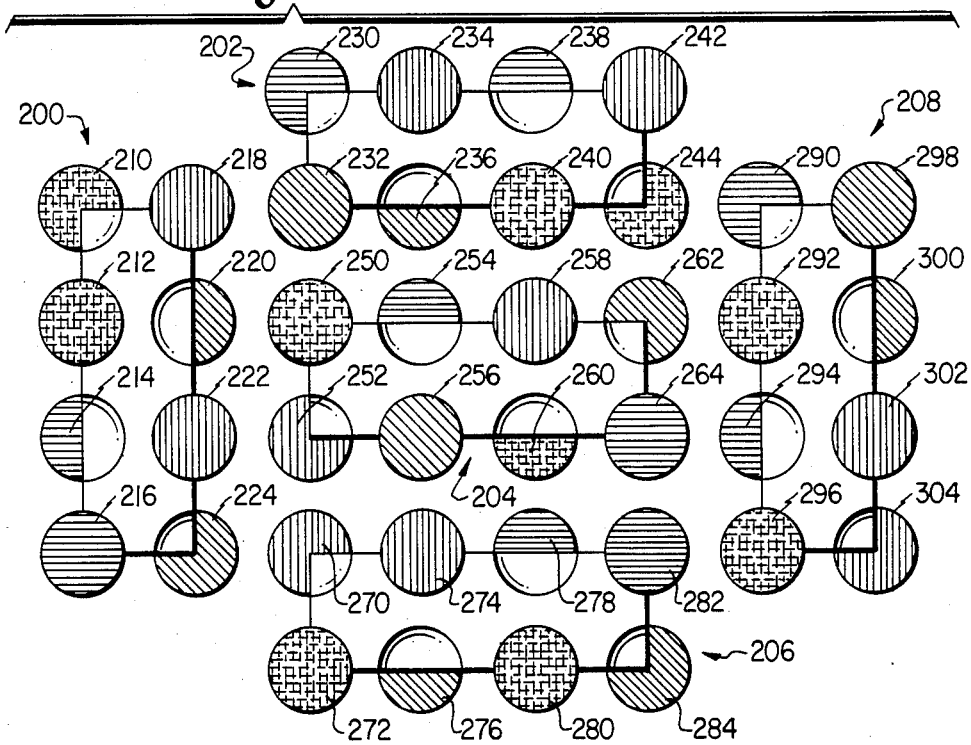

Fig. 3
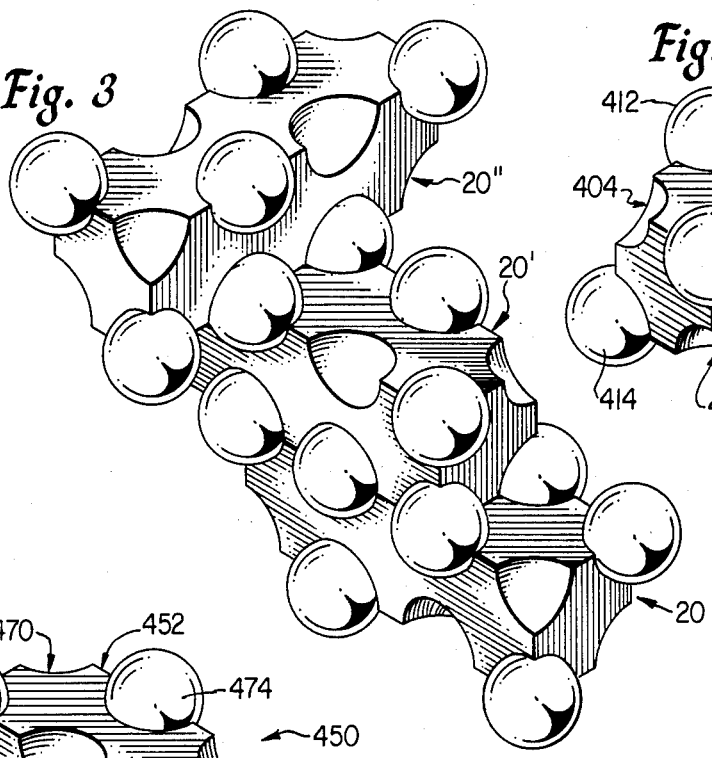
Fig. 4
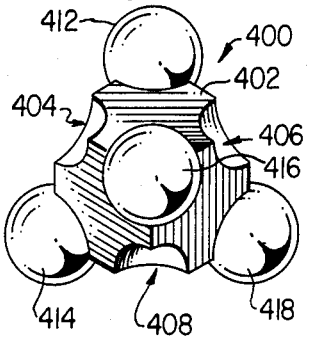
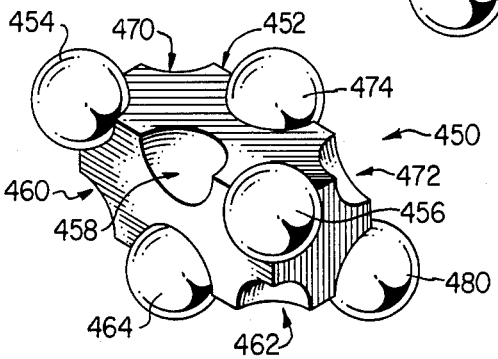
Fig. 5
Fig. 6
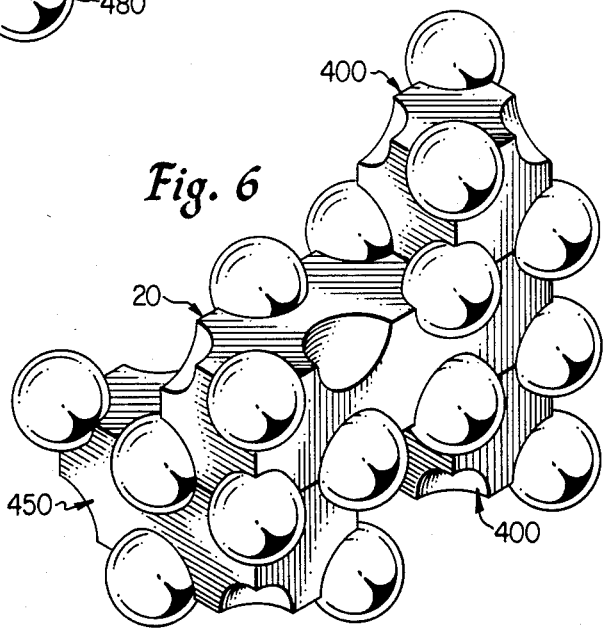

Fig. 7
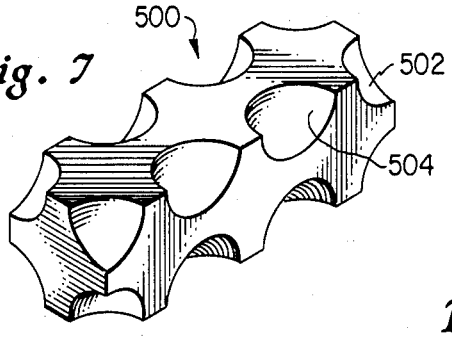
Fig. 8
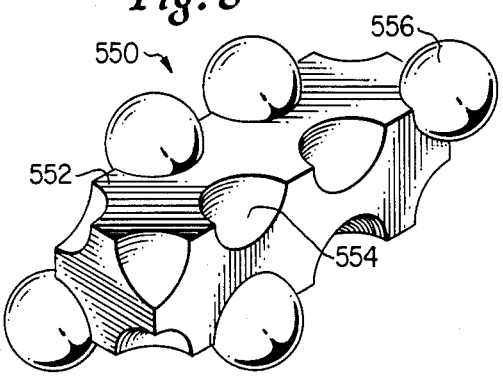
Fig. 9
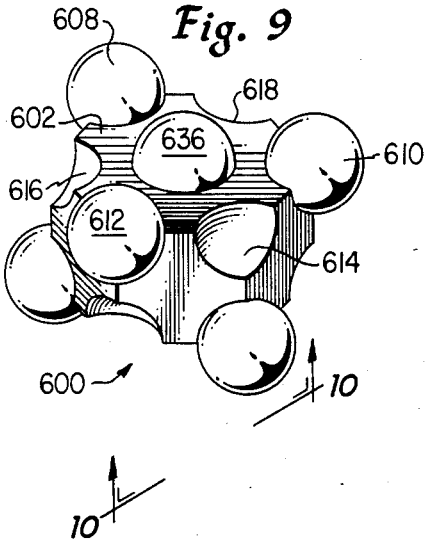
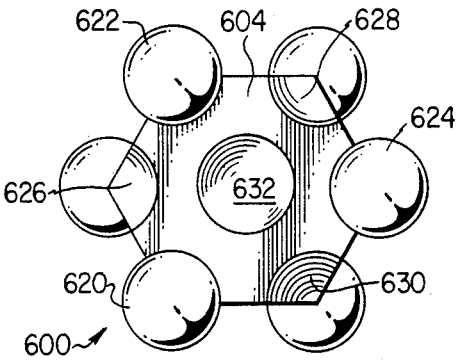
Fig. 10

INTERLOCKING PUZZLE BLOCKS

TECHNICAL FIELD

This invention relates to puzzle building blocks and more particularly to blocks having a predefined number of spherical protrusions and spherical receiving sockets to facilitate interlocking of the blocks.

BACKGROUND ART

Numerous designs have been used for toy and structural building blocks. Examples of the toy building blocks are disclosed in the patents to N. I. Paulson, U.S. Pat. Nos. 2,262,199, 3,405,479 and 3,481,068; G. Morin, U.S. Pat. No. 3,420,527; Yoshihiro Kishi, U.S. Pat. No. 3,570,170; Takashi Matsubayashi, et al., U.S. Pat. No. 3,605,322; C. O. Perry, U.S. Pat. No. 3,611,620; J. Pippet, U.S. Pat. No. 3,716,939; W. Schnabel, U.S. Pat. No. 3,717,946; J. B. De Vos, U.S. Pat. No. 3,822,499; G. Vogel, U.S. Pat. No. 3,862,512; J. A. Gale, U.S. Pat. No. 4,129,960 and Y. Chatani, et al., U.S. Pat. No. 4,306,373. An example of structural interconnecting blocks is shown in the patent to G. L. Hernandez, U.S. Pat. No. 4,060,952.

In each of the disclosures of these patents, building blocks are provided having structure for permitting the interconnection of the individual blocks. In each of these cases, the interconnection is by way of protrusions from one or more faces of the blocks which protrusions are received in apertures also provided in the blocks. The protrusions and receiving apertures are generally sized for a snug or interference fit to effect an interlocking force upon engagement of one block to another. By way of example only, in the patent to Y. Chatani, et al., U.S. Pat. No. 4,306,373, a frictional interconnecting toy block is provided having a male cylindrical coupler extending from selected sidewalls of a cube for engagement within a female receiving aperture. The male cylindrical couplers are sized to provide an interlocking fit upon engagement of the male coupler into the female coupler. In this arrangement, as is generally the case, upon interconnection of one block with another, the male coupler is completely received within the female coupler and is not viewable after interconnection.

Similar interconnecting blocks have been used as game pieces for use in playing games or solving puzzles defined by use of such blocks. Examples of such structures are shown in the patents to M. J. J. Sugden, U.S. Pat. No. 3,481,603; D. Wolf, U.S. Pat. No. 3,672,681; and to D. G. Henderson, U.S. Pat. No. 4,239,233.

In these patents, interconnecting blocks have either male or female coupling structures formed on one or more faces of the blocks for engagement with corresponding female or male coupling structures, respectively. In the patent to D. Wolf, cubes are formed with holes in the faces thereof and assembly of the cubes is achieved by using a tubular coupling member for insertion into the apertures of a pair of the playing pieces. In these structures, the coupling protrusions are also hidden from view upon assembly. Thus, these elements of the building blocks are not used as a part of the overall finished design and likewise are not intended for use as part of the puzzle or game associated with the assembly of the component blocks.

DISCLOSURE OF THE INVENTION

The present invention relates to building blocks used with other blocks of similar design. Further, the blocks of the present invention may be used as components of a puzzle wherein the object is to align a maximum number of similarly colored spheres which extend from and make up a part of each building block. According to one form of the invention, the building blocks each comprise a member in the form of a rectangular parallelepipedon. Protrusions are attached to and extend from the member on nonadjacent corners and receiving indentions are formed on the corners of the member other than those at which the protrusions were attached. These indentions cooperate and receive the protrusions such that blocks may be interconnected.

In a more specific embodiment of the invention, the protrusions are portions of spheres and the indentions are spherical sockets for receiving at least a portion of the spheres therein. More specifically, each block has a predetermined number of spheres attached to and extending from the block member and a plurality of receiving sockets. In one form of the invention, the spheres and sockets are alternately placed along the long edges of each building block member.

In one form of the invention, each building block is a parallelepipedon with the sides thereof being rectangular, the height of each side being equal to one third the length. The ends of the parallelepipedon are square. In this embodiment, the blocks are elongated having a square cross section and a length which is three times the dimension of one side of the square cross section. The spherical protrusions are attached to the block member at spaced distances along the long edges thereof, the spheres being separated by corresponding spherical sockets. In the primary embodiment, nonadjacent corners of each block member has a sphere attached thereto such that the center of the sphere lies on the corner of the block member as defined by the intersection of the extension of the side edge and the edges of the end face. These spheres attached along the long edge of the block member are positioned such that the center of the spheres lie on an extension of the edge of the block member.

In a further embodiment of the invention, the spheres on each block are of varying colors with specific colors in differing but prescribed positions such that by arranging a plurality of the blocks in a specified interconnected arrangement, a plurality of spheres of identical color are aligned.

Although in a primary embodiment of the invention, each block member has a predetermined number of spheres attached to and extending from the block member and a corresponding number of receiving sockets, in one alternative form of the invention, the block members have a noncorresponding number of spheres and receiving sockets. In another form of the invention, block members may be formed having only spheres extending therefrom, without any sockets, or alternatively, only sockets, without any spheres extending therefrom.

BRIEF DESCRIPTION OF THE DRAWINGS

For a more complete understanding of the present invention, and for further details and advantages thereof, reference is now made to the following Detailed Description taken in conjunction with the accompanying Drawings, in which:

FIG. 1*a* is a perspective view of one of the building blocks of the present invention, looking from the upper right, and FIG. 1*b* is a perspective view of the same building block looking from the upper left.

FIG. 2 is a schematic diagram showing five building blocks according to the present invention using the diagrammatic representation employed in trademark cases to show one arrangement of colors applied to the spheres attached to the individual blocks.

FIG. 3 is a perspective view showing three of the building blocks of FIG. 1 interconnected;

FIG. 4 is a perspective view of an alternative building block having a length equal to the height and width thereof;

FIG. 5 is a perspective view of an alternative embodiment of the building block of the present invention wherein the length is twice the height and width of the block;

FIG. 6 is a perspective view showing an assemblage of the three alternative building blocks illustrated in FIG. 1*a*, 1*b*, 4 and 5.

FIG. 7 is a perspective view of a further embodiment of the building block of the present invention wherein the block has a plurality of sockets therein without any spheres extending therefrom;

FIG. 8 is a perspective view of a further alternative building block of the present invention wherein the sockets and spheres are not alternately positioned on the block member;

FIG. 9 is a perspective view of an alternative building block of the present invention having a pair of opposed hexagonal faces;

FIG. 10 is a plan view of the building block of FIG. 9 as seen from along line 10—10;

DETAILED DESCRIPTION

Figure 11:
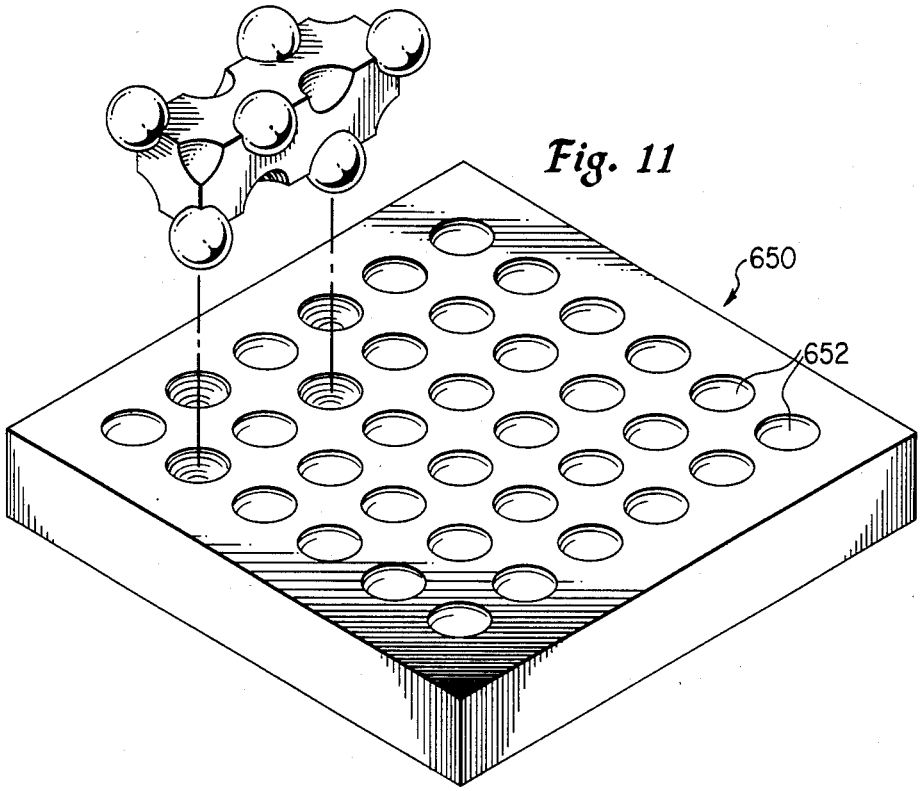
FIG. 11 is a perspective view of one of the building blocks according to the present invention and a base used for supporting the block.

Referring to FIGS. 1*a* and 1*b*, building block 20 is shown from the upper right and upper left, respectively. Block 20 includes an elongated body 22 in the form of a parallelepipedon. Body 22 has four elongated sides 24, 26, 28 and 30 and ends 32 and 34. Body 22 further is defined by a plurality of long edges, 50, 52, 54 and 56. These edges are defined by the intersection of elongated sides 24, 26, 28 and 30 and are interrupted by a plurality of spheres and sockets, to be described below.

Body 22 further has side edges 60, 62, 64 and 66 defined by the intersection of the elongated sides and end 32. These edges are also interrupted by a plurality of spheres and sockets as will be described below. A plurality of side edges 70, 72, 74, and a hidden side edge opposite edge 70, are defined by the intersection of elongated sides and end 34. These edges are also interrupted by plurality of spheres and sockets.

As can be seen in FIGS. 1*a* and 1*b*, a plurality of spherical sockets 100, 102, 104, 106, 108, 110, 112 and 114 are formed in body 22 at either the corner of or on one of the edges of body 22. For example, sockets 104 and 112 are at nonadjacent corners of body 22. Sockets 102 and 110 are at nonadjacent corners of body 22. The remaining sockets are positioned intermediate of the ends 32 and 34 of body 22 and positioned on the long edges 50, 52, 54 or 56.

A plurality of spheres are alternately positioned intermediate of the sockets just defined. Specifically, spheres 140, 142, 144, 146, 148, 150, 152, and 154 are mounted to body 22 such that a portion of each sphere equal to the volume of a corresponding socket is embedded in body 22. One way of construction of the building block of the present invention is to form sockets at the location of each of spheres 140 through 154 and then to attach a sphere in the socket. Alternatively, the sphere may be molded as one piece of body 22. In either event, in the primary embodiment, spheres 140–154 are positioned such that their centers are aligned with the extension of the long edges of body 22. Spheres 140, 148, 146 and 154, positioned at the end of body 22, are aligned such that their centers are coincident with the intersection of the corresponding long edge and side edges adjacent thereto.

FIG. 2 shows in schematic representation five building blocks 200, 202, 204, 206, and 208 with spheres attached thereto as described with respect to FIGS. 1*a* and 1*b*. The spheres are lined for color, using the lining designations incorporated in the rule of trademark practice for the United States Patent and Trademark Office. Block 200 include spheres 210, 212, 214, 216, 218, 220, 222, and 224. Spheres 210 and 212 are lined for yellow, spheres 214 and 216 are lined for blue, spheres 218 and 222 are lined for red and spheres 220 and 224 are lined for green. Referring to block 202, spheres 230 and 238 are lined for blue, spheres 232 and 236 are lined for green, spheres 234 and 242 are lined for red and spheres 240 and 244 are lined for yellow. With respect to block 204, spheres 250 and 260 are lined for yellow, spheres 252 and 258 are lined for red, spheres 254 and 264 are lined for blue and spheres 256 and 262 are lined for green. With respect to block 206, spheres 270 and 274 are lined for red, spheres 278 and 282 are lined for blue, spheres 272 and 280 are lined for yellow and spheres 276 and 284 are lined for green. With respect to block 208, spheres 290 and 294 are lined for blue, spheres 292 and 296 are lined for yellow, spheres 298 and 300 are lined for green and spheres 302 and 304 are lined for red.

As can be seen, blocks 200, 202, 204, 206 and 208 are identical except that the colors of the spheres are positioned differently from one block to the other. Spheres and sockets are positioned in the same relative locations but colors of spheres and specific locations for each color differ from one block to the other. It will of course be recognized, by those skilled in the art that variations can be had both in changing of sphere colors and in positioning of the spheres with respect to each other and the open sockets. Further, spheres may be of different colors than those named, or may all be of the same color. However, with the combination shown in FIG. 2, the spheres may be arranged in the form of an interlocking building block form such that five like colored spheres are aligned in a row for all four colors. Thus, the present invention is adapted to serve as a challenging puzzle which would require manipulation of the individual blocks for interconnection in an attempt to align spheres of like color. For example, FIG. 3 illustrates the interconnection of three of the building blocks, demonstrating the manner in which the spheres engage sockets of adjacent blocks to provide an interconnected assemblage of blocks. Thus, FIG. 3 shows a first building block 20, a second building block 20′ engaged thereover and a third building block 20″ positioned laterally over block 20′.

FIGS. 4 and 5 show modifications of block 20 shown in FIGS. 1*a* and 1*b*. Referring to FIG. 4, block 400 includes a body 402 which is a cube having sockets 404, 406 and 408 formed at three nonadjacent corners. Four spheres 412, 414, 416 and 418 are positioned alternately of the sockets at corners of body 402. A socket (not shown in FIG. 4) is also formed on the corner opposite that to which sphere 416 is attached.

Although the primary use of block 400 shown in FIG. 4 is as a building block or puzzle piece, block 400 also serves as a four sided die. For example, where spheres 412, 414, 416 and 418 are spheres of different colors, or represent different numerical values, block 400 may be positioned on a surface such that one of the four spheres is at the apex with the remaining three spheres serving as the base on which the block rests. Thus, by tossing block 400 onto a horizontal surface, one of the four spheres will be positioned in the up position to designate the value or color casts on that roll. Thus, block 400 is unique in providing a four sided die for use in any type of game or the like.

Referring to FIG. 5, a block 450 is shown and is of is similar design to block 20 but having a long dimension of approximately twice that of the end side dimension. The block accommodates either two spheres and a socket or two sockets and a sphere on each long edge. Thus, the block includes a body 452 with spheres 454, 456 and socket 458 along one long edge, sockets 460 and 462 and sphere 464 along another long edge,.and sockets 470 and 472 and sphere 474 along another long edge. Along the long edge not fully shown in FIG. 5, spheres are located at the corner points with a socket intermediate thereof. One of the spheres, sphere 480 is shown in FIG. 5.

FIG. 6 shows an assemblage of the various blocks illustrated in FIGS. 1*a*, 1*b*, 4 and 5. A block 20 is interconnected over blocks 450 and 400. A second block 400 is positioned over block 20.

The present invention provides building or puzzle blocks wherein, in the primary embodiment, an elongated body portion in the form of a rectangular parallelepipedon has a plurality of spheres attached along the edges thereof and of spaced distances. An equal number of sockets are formed at spaced distances on the edges and intermediate of the spheres. The spheres may be of a common or different colors. The blocks are interconnected by stacking such that the spheres of one block engage the sockets of an adjacent block or blocks. Where the blocks are used in a puzzle arrangement, the puzzle is solved where a designated number of spheres of like color are positioned in a row. In a secondary embodiment, the blocks may be substantially cubical in shape or may be of intermediate lengths.

FIG. 7 shows a modification of block 20 illustrated in FIGS. 1*a* and 1*b*. Block 500, referred to as a skeleton block, includes a plurality of spaced sockets 502 at each corner thereof and a plurality of sockets 504 along the edges of the body of block 500 intermediate of the corner sockets. Thus, block 500 does not include any spheres extending therefrom as is found in blocks 20, 400, and 450. As can be appreciated, where blocks according to the present invention are used as building blocks or in solving a block puzzle to align spheres of various colors or form a desired pattern of spheres, skeleton block 500 can be incorporated as necessary.

FIG. 8 shows a further modification of block 200. Block 550 includes a body 552 having a plurality of sockets 554 and spheres 556. However, the spheres and sockets are not alternately positioned as in block 20, block 400 or block 450, shown in FIGS. 1*a*, 1*b*, FIG. 4 and FIG. 5, respectively. Thus, block 550 may be used to either assist, or to make the assemblage of blocks according to the present invention more difficult. As will be appreciated, and as is illustrated with respect to FIG. 6, the various modified blocks may be used in a single assemblage of components.

FIGS. 9 and 10 show a further modification of building blocks according to the present invention. Referring to FIG. 9, block 600 includes opposed hexagon faces 602 and 604 (FIG. 10). Spheres 608, 610 and 612 are positioned at alternating corners defined by the corners of hexagon face 602. Sockets 614, 616 and 616 are positioned at the remaining corners. As can be seen in FIGS. 9 and 10, the opposite face 604 likewise receives three spheres 620, 622, and 624 separated by socket 626, 628 and 630. A socket 632 is positioned at the center of face 604. A sphere 636 is positioned in the center of face 602. Referring to FIG. 11, a receiving board 650 may be used as a base for receiving blocks thereon. Board 650 has a plurality of sockets 652 which are spaced to correspond to the sphere and socket spacing of the blocks of the present invention. Thus, although the present invention envisions the use of blocks having non-alternating spheres and sockets, such blocks may be positioned in an appropriate orientation by use of board 650.

Figure 12:
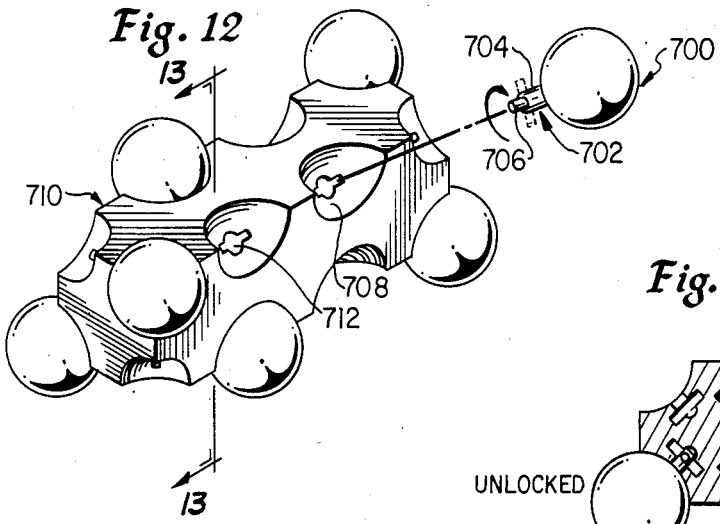
FIG. 12 is a perspective view of one of the building blocks according to the present invention modified to permit the removal and replacement of spheres.
Figure 13:
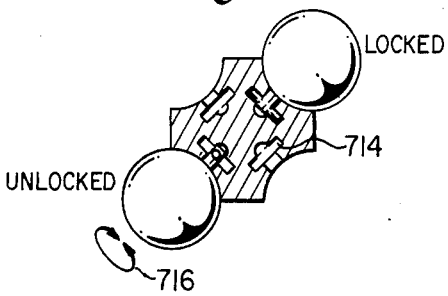
FIG. 13 is a section view taken along line 13—13 at FIG. 12.

In an alternative embodiment of the invention shown in FIGS. 12 and 13, the blocks and spheres may be made such that the spheres may be removed and moved from socket to socket as desired. While various structures may be used to accomplish this arrangement, one such structure is shown in FIGS. 12 and 13. Referring first to FIG. 12, sphere 700 is designed having a T extension 702 extending radially therefrom. Extension 702 may be formed with a cylindrical portion 704 having arms 706 extending perpendicularly therefrom. Socket 708 of block 710 has a slot 712 formed therein with a relieved circular cavity 714 (FIG. 13) for receiving extension 702, and particularly arms 706, therein. As can be appreciated from viewing FIG. 13 showing slot 712 and circular cavity 714, sphere 700 may be attached to block 710 by merely inserting extension 704 into slot 712 and rotating the sphere, as shown by arrow 716 such that arms 706 move within cavity 714 but out of registration with slot 712.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

I claim:

1. A building or puzzle block comprising:

a body portion, spheres attached to said body portion at selected corners thereof such that the center of each said sphere lies on an extension of the respective corner defining edges of said body portion, and receiving sockets formed on corners of said member, other than those on which the spheres are attached, for interconnecting receipt of spheres on other blocks.

2. The block according to claim 1 wherein said body portion is a polyhedron.

3. The block according to claim 2 further comprising spheres attached to said body portion along edges thereof such that the center of each said sphere lies on an extension of the edge on which each said sphere is attached.

4. The block according to claim 2 wherein said polyhedron is a rectangular parallelepipedon.

5. The block according to claim 2 wherein said polyhedron includes a pair of opposed hexagonal faces separated by a plurality of rectangular walls wherein opposing sides of said rectangular walls correspond to the edges of the hexagonal faces.

6. The block according to claim 5 further comprising a sphere extending from the center of one of said hexagonal faces, with the center of said sphere positioned in the plane of said face and a socket formed in the center of the opposite hexagonal face.

7. The block according to claim 1 wherein said spheres may be removed from said selected corners and reattached to said body portion at selected ones of the receiving sockets.

8. A building block comprising:

a member in the form of a rectangular parallelepipedon, the sides of said parallelepipedon being rectangular with the height of each side being equal to one-third of the length of each said side, spheres of different colors attached to said member on non-adjacent corners, spheres of different colors attached to said member at spaced distances along the long edges thereof, separated by corresponding indentions at equal distances along the long edge thereof, and receiving indentions formed on the corners of said member, other than those of which the spheres are attached, for inter-connecting receipt of spheres on other building blocks.

9. The building block according to claim 8 wherein said spheres may be removed from said member and repositioned in one of the receiving indentions.

10. A puzzle block comprising:

an elongated body portion in the form of a rectangular parallelepipedon, spheres attached to said body portion along edges thereof and at spaced distances, said spheres being attached to said body portions such that the center of each said sphere lies on an extension of the edge of said body portion, and an equal number of receiving voids formed at spaced distances on said edges for inter-connecting said block with other similar blocks.

11. The puzzle block according to claim 10 further comprising spheres attached to said body portion on non-adjacent corners.

12. The puzzle blocks according to claim 11 wherein said spheres attached to said corners are mounted such that the centers thereof are coincident with the corners of said body portion.

13. The puzzle block according to claim 11 wherein said spheres may be selectively removed from said body portion and reattached thereto at selected ones of the receiving voids.

14. The puzzle block according to claim 10 wherein said spheres are different colors permitting inter-connection of said blocks to align a plurality of spheres of the same color.

15. A puzzle block, said block having coupling means for inter-connection with other blocks, comprising:

an elongated body portion having a substantially square cross-section and a length at least as long as the dimension of one side of said square cross-section, spheres attached to said body portion along edges thereof, said spheres being attached to said body portions such that the center of each said sphere lies on an extension of the edge of said body portion, and voids formed at spaced distances on said edges for receiving said spheres to inter-connect said block with other similar block.

16. The puzzle block according to claim 15 further comprising spheres mounted on said body portion on non-adjacent corners.

17. The puzzle block according to claim 16 wherein the spheres mounted on said corners are mounted such that the centers of said spheres are coincident with the corners of said body portions.

* * * * *